US009584902B2

(12) United States Patent
Akino

(10) Patent No.: US 9,584,902 B2
(45) Date of Patent: Feb. 28, 2017

(54) DYNAMIC MICROPHONE AND METHOD OF FORMING BACK-SIDE AIR CHAMBER

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-shi, Tokyo (JP)

( * ) Notice: Subject to any disclaimer, the term of this patent is extended or adjusted under 35 U.S.C. 154(b) by 0 days.

(21) Appl. No.: 14/727,120

(22) Filed: Jun. 1, 2015

(65) Prior Publication Data

US 2015/0382102 A1 Dec. 31, 2015

(30) Foreign Application Priority Data

Jun. 27, 2014 (JP) ..... 2014-132174

(51) Int. Cl.

| | |
|---|---|
| ***H04R 1/20*** | (2006.01) |
| ***H04R 1/28*** | (2006.01) |
| *H04R 31/00* | (2006.01) |
| *H04R 9/08* | (2006.01) |

(52) U.S. Cl.

CPC ..... *H04R 1/2876* (2013.01); *H04R 9/08* (2013.01); *H04R 31/00* (2013.01)

(58) Field of Classification Search

CPC ..... H04R 9/08; H04R 1/2876; H04R 1/28; H04R 1/342

See application file for complete search history.

(56) References Cited

U.S. PATENT DOCUMENTS

| | | | | |
|---|---|---|---|---|
| 2,463,762 A * | 3/1949 | Giannini | H04R 1/342 181/125 |
| 3,381,773 A * | 5/1968 | Schenkel | H04R 1/22 181/158 |
| 5,148,492 A * | 9/1992 | Uzawa | H04R 9/08 181/166 |
| 7,720,239 B2 * | 5/2010 | Akino | H04R 19/04 381/174 |

(Continued)

FOREIGN PATENT DOCUMENTS

| | | |
|---|---|---|
| JP | 3882268 B2 | 2/2007 |
| JP | 2009071752 A * | 4/2009 |

*Primary Examiner* — Curtis Kuntz
*Assistant Examiner* — Ryan Robinson
(74) *Attorney, Agent, or Firm* — Manabu Kanesaka

(57) ABSTRACT

A dynamic microphone which prevents a wall forming a back-side air chamber from having a certain resonance frequency and effectively prevents the generation of standing waves in the back-side air chamber is provided. A dynamic microphone includes a dynamic microphone unit including a diaphragm configured with a voice coil and a magnetic circuit having a magnetic gap provided so as to allow the voice coil to vibrate, a bottomed case which is coupled to the dynamic microphone unit and forms a back-side air chamber communicating with back side of the diaphragm, and an acoustic resistance body which is pressingly attached in the case and composed of metal fiber including a pocket, an open cross sectional area of the pocket gradually decreasing toward the direction remote from the dynamic microphone unit.

17 Claims, 3 Drawing Sheets

(56) References Cited

U.S. PATENT DOCUMENTS

| | | | | |
|---|---|---|---|---|
| 8,031,898 | B2 * | 10/2011 | Akino | H04R 9/025 381/177 |
| 8,406,446 | B2 * | 3/2013 | Akino | H04R 1/2876 381/354 |
| 8,644,544 | B2 * | 2/2014 | Akino | H04R 1/283 381/150 |
| 8,761,427 | B2 * | 6/2014 | Akino | H04R 9/08 381/355 |
| 2007/0269059 | A1 * | 11/2007 | Akino | H04R 1/245 381/170 |
| 2008/0112582 | A1 * | 5/2008 | Lai | B06B 1/0637 381/190 |
| 2015/0189417 | A1 * | 7/2015 | Akino | H04R 19/04 381/356 |

* cited by examiner

DYNAMIC MICROPHONE AND METHOD OF FORMING BACK-SIDE AIR CHAMBER

BACKGROUND OF THE INVENTION

Field of the Invention

The present invention relates to a dynamic microphone having an improved air chamber formed in the back portion of a dynamic microphone unit and a method of forming a back-side air chamber.

Description of the Related Art

It is well-known that the omnidirectional dynamic microphone operates by resistance control and the unidirectional dynamic microphone operates by mass control and resistance control.

The resistance control of the dynamic microphone is carried out by an acoustic resistance provided very close to the back side of a diaphragm and a back-side air chamber, in which no acoustic wave enters, provided in the back side of the acoustic resistance. The acoustic resistance is located at the inlet of the back-side air chamber. When the volume of the back-side air chamber is significantly large, the total impedance of the acoustic resistance and the impedance of the air chamber is substantially equivalent to the acoustic resistance.

When the volume of the back-side air chamber is small, the impedance of the air chamber due to the stiffness of the air chamber works in series with the acoustic resistance at low frequency.

Thus for a back-side air chamber designed small, the frequency response at low frequency degrades and the directionality at low frequency also changes. It is unrealistic to infinitely increase the volume of the back-side air chamber. Handheld dynamic microphones, in particular, have more strict limitation on the volume of the back-side air chamber.

When a portion of the wall surrounding the back-side air chamber vibrates, the change in the volume of the air chamber generates acoustic waves, and the acoustic waves reaches the diaphragm via the acoustic resistance. Thus when a portion of the wall of the air chamber vibrates, the directional frequency response of the microphone degrades at and near the frequency of the resonance frequency of the vibration portion of the wall.

When an air chamber having a form of a bottomed pipe is used, a standing wave is generated along the longitudinal direction. The standing wave is generated by the acoustic waves entering the air chamber via the acoustic resistance. Typically, the generation of standing waves is avoided by providing a sponge or the like, which has small acoustic resistance, inside the air chamber.

In this case, the space in which the acoustic resistance provided inside the air chamber to avoid standing waves should be as small as possible, because the acoustic resistance is provided equivalently in series with the acoustic resistance for carrying out the resistance control.

JP 3882268 B1 discloses a dynamic microphone configured to have an open cross sectional area of the back-side air chamber becoming smaller in a cross section further remote from the diaphragm.

In the dynamic microphone disclosed in JP 3882268 B1, the microphone grip (grip case) and the back-side air chamber contained in the microphone grip are formed to have an open cross sectional area decreasing toward the rear end, so as to suppress the generation of standing waves inside the microphone grip and the back-side air chamber.

For the dynamic microphone disclosed in JP 3882268 B1, the external shape of the wall of the back-side air chamber and the internal shape of the microphone grip should be substantially identical to efficiently make use of the volume inside the microphone grip as illustrated in FIG. 1 in JP 3882268 B1.

As explained above, the volume of the back-side air chamber is preferably provided as large as possible. However, the dynamic microphone disclosed in JP 3882268 B1 is disadvantageous in that the volume of the air chamber is limited because the back-side air chamber is formed, for example, in a conical shape.

SUMMARY OF THE INVENTION

The object of the present invention is to provide a dynamic microphone which can include a large back-side air chamber by efficiently using the volume inside the grip case, avoids the wall surrounding the back-side air chamber having a resonance frequency at a certain frequency, and effectively prevents the generation of standing waves in the back-side air chamber, and a method of forming the back-side air chamber.

To achieve the object, a dynamic microphone according to the present invention includes a dynamic microphone unit including a diaphragm including a voice coil and a magnetic circuit including a magnetic gap, the voice coil being disposed in the magnetic gap so as to vibrate, a bottomed case coupled to the dynamic microphone unit and forming a back-side air chamber communicating with back side of the diaphragm, and an acoustic resistance body formed of metal fiber including a pocket and attached to the inside of the case, the pocket being formed to have an open cross sectional area gradually decreasing toward a direction remote from the dynamic microphone unit.

Aluminum fiber is preferably used for the metal fiber. The dynamic microphone may be configured to include a plurality of pockets, each of the pockets being formed to have an open cross sectional area gradually decreasing toward a direction remote from the dynamic microphone unit.

In addition, the metal fiber pressingly attached to the inside of the case is preferably in tight contact with an internal surface of the case.

The grip case supporting the dynamic microphone unit can be used as the case forming the back-side air chamber. Alternatively, in a preferable configuration, the case forming the back-side air chamber is contained in the grip case configured to support the microphone unit.

In addition, preferably, the case is coaxially attached inside the grip case via a shock-mount member.

In addition, the acoustic resistance body is desirably has fiber density distribution such that fiber density is low in a portion close to an opening of the case and high in a portion close to a bottom of the case.

A method of forming a back-side air chamber communicating with back side of a diaphragm of a dynamic microphone unit according to the present invention includes: inserting a certain amount of metal fiber in a bottomed case having an opening which communicates with the back side of the diaphragm; forming a pocket in the metal fiber in the case by plastic deformation by inserting a rod member having a protrusion of which outer diameter decreases toward distal end, from the opening of the case, the pocket being formed in a shape corresponding to a shape of the protrusion of the rod member; and pulling out the rod member from the opening of the case to obtain an acoustic resistance body formed of metal fiber having a pocket in an internal bottom section of the case, the pocket having a gradually decreasing open cross sectional area to form the back-side air chamber.

In the method of forming a back-side air chamber, the metal fiber desirably comes in tight contact with an internal surface of the case by the forming, by plastic deformation, of a pocket having a shape corresponding to a shape of the protrusion of the rod member in the metal fiber, and aluminum fiber is preferably used as the metal fiber.

In the dynamic microphone and the method of forming the back-side air chamber as described above, the metal fiber, such as aluminum fiber, is inserted in the bottomed case, and the metal fiber is plastically deformed by the rod member having a protrusion of which outer diameter decreases toward the distal end, being pushed into the bottomed case.

In this manner, the metal fiber is formed into the acoustic resistance body having a pocket of which open cross sectional area gradually decreasing toward the direction remote from the dynamic microphone unit.

When the rod member pushes the metal fiber into the bottomed case, the metal fiber pressed by the rod member is pressingly attached to the internal of the case. In this manner, the metal fiber is fixed to be in tight contact with the internal surface of the case.

Since the pocket formed in the acoustic resistance body formed of metal fiber has the open cross sectional area gradually decreasing toward the direction remote from the dynamic microphone unit, the acoustic resistance correspondingly increases toward the direction remote from the dynamic microphone unit. This effectively avoids the generation of standing waves in the back-side air chamber.

Since the metal fiber is pressingly attached to, and in tight contact with, the internal surface of the case constituting the back-side air chamber, the metal fiber suppresses the free vibration of the wall constituting the case. Thus a dynamic microphone which effectively avoids the wall of the back-side air chamber having a certain resonance frequency can be provided.

DESCRIPTION OF THE PREFERRED EMBODIMENTS

Figure 1:
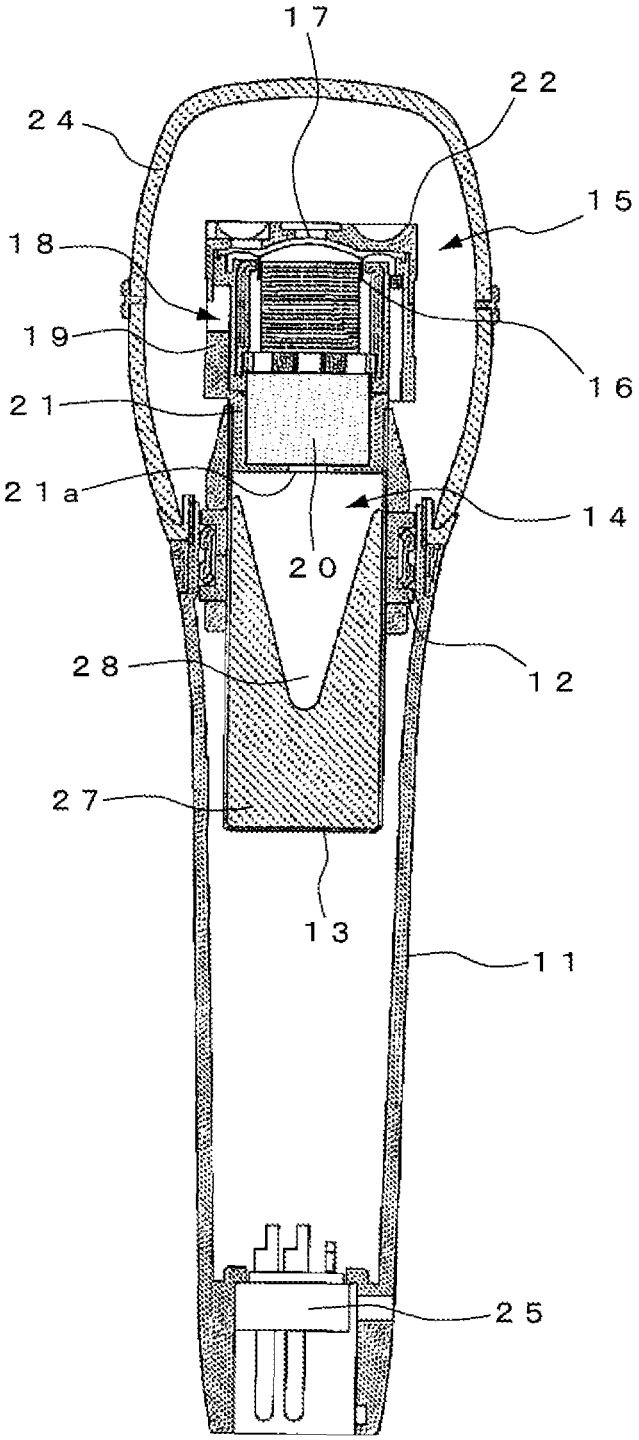
FIG. 1 is a center cross sectional view illustrating the general configuration of a dynamic microphone according to the present invention.

A dynamic microphone according to the present invention will be described based on an embodiment illustrated in the drawings.

FIG. 1 illustrates a first embodiment. The example illustrated in FIG. 1 is mainly used by a vocalist and a person making a speech, and includes a cylindrical grip case 11 made of, for example, a brass alloy.

A bottomed case 13 formed of, for example, an aluminum material is coaxially attached inside the grip case 11 via a shock-mount member 12 made of an elastic rubber part. The bottomed case 13 constitutes the back-side air chamber 14 of the dynamic microphone unit as will be described below.

A dynamic microphone unit 15 is attached to the front end of the case 13. The dynamic microphone unit 15 is known to include a diaphragm 17 including a voice coil 16 and a magnetic circuit 18 including a magnetic gap in which the voice coil 16 is disposed so as to vibrate. The microphone unit 15 is attached with the outer periphery of a yoke constituting the magnetic circuit 18 fitted in a cylindrical unit holder 19.

A cap member 21 having a sound hole 21*a* in the center and containing the acoustic resistance body 20 is engagingly attached to the rear end of the unit holder 19. The back side of the diaphragm 17 constituting the dynamic microphone unit 15 communicates with the back-side air chamber 14 in the case 13 via the acoustic resistance body 20 and the sound hole 21*a*.

A resonator 22 is attached to the front end of the unit holder 19 so as to cover the diaphragm 17.

A protection cover 24 having a metal mesh is attached to the front end of the grip case 11 so as to cover the dynamic microphone unit 15.

An output connector 25 is attached to the rear end of the grip case 11.

In the embodiment, the acoustic resistance body 27 formed of metal fiber (aluminum fiber in the embodiment) is contained in the bottomed case 13 forming the back-side air chamber 14. As in the example illustrated in FIG. 1, a pocket 28 is formed in the central portion of the acoustic resistance body 27 so that the open cross sectional area gradually decrease toward the direction remote from the microphone unit 15.

In other words, the acoustic resistance body 27 is contained in the case 13 so that the cross sectional area taken perpendicular to the longitudinal direction of the case 13 increases toward the direction remote from the microphone unit 15.

The acoustic resistance body 27 formed of metal fiber contained in the bottomed case 13 will be described in detail referring to FIGS. 2A, 2B, and 2C which explain the method of forming the acoustic resistance body 27.

Figure 2C:
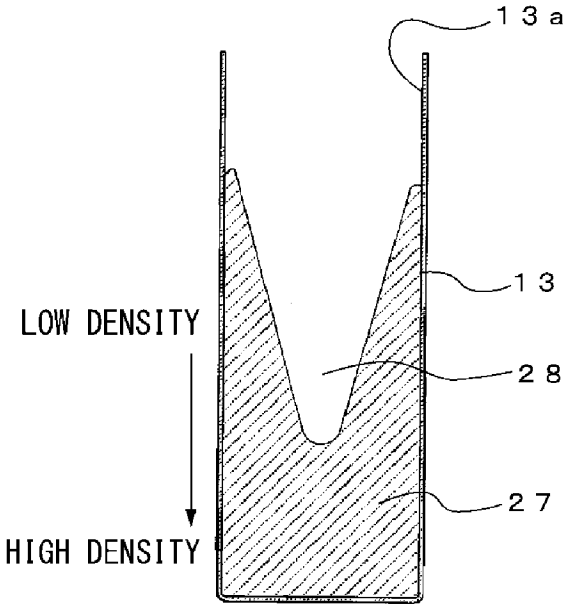
FIGS. 2A to 2C are a process view of forming a back-side air chamber in the dynamic microphone illustrated in FIG. 1.
Figure 2B:
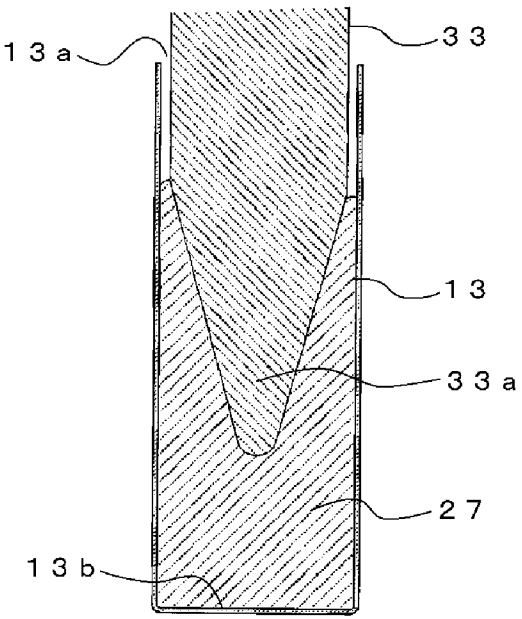
Figure 2A:
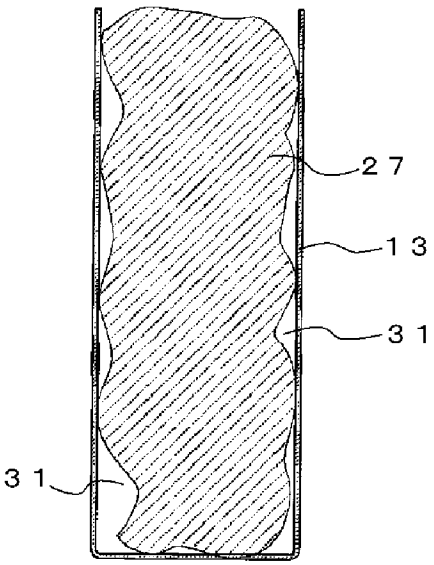

FIGS. 2A, 2B, and 2C explain the method of forming the acoustic resistance body 27 formed of metal fiber. The metal fiber for the acoustic resistance body 27 is disclosed in, for example, JP 3856790 B1, and an aluminum fiber with the wire diameter of 50 to 100 μm can preferably be used.

The aluminum fiber can be produced by rapid solidification in which a molten aluminum is ejected from, for example, an ejection-nozzle hole into an air atmosphere.

The aluminum fiber thus produced has a certain area density of long aluminum fibers under uncompressed state, similar to cotton fiber, for example.

The acoustic resistance body 27 is formed in the case 13 with this aluminum fiber by injecting a predetermined amount of aluminum fiber (indicated by 27, which is the same reference sign as the acoustic resistance body) in the bottomed case 13 constituting the back-side air chamber 14 as illustrated in FIG. 2A.

In this state, the aluminum fiber 27 is uncompressed, and a certain gap 31 exists between the aluminum fiber 27 and the internal surface of the case 13.

Then a rod member 33 having a protrusion 33*a* of which outer diameter decreases toward the distal end is inserted in the case 13 from the opening 13*a*. The rod member 33 is formed of, for example, a brass alloy. As illustrated in FIG. 2B, the outer diameter of the rod member 33 is slightly smaller than the inner diameter of the case 13.

The protrusion 33*a* of the rod member 33 has a substantially conical shape in the example. The aluminum fiber 27 inserted in the case 13 is pressed downward by the rod member 33 and compressed against the bottom end 13*b* of the case 13.

In this manner, the central portion of the aluminum fiber 27 in the case 13 is plastically deformed and the pocket 28 having a shape corresponding to a shape of the protrusion 33*a* of the rod member 33 is formed.

Simultaneously, the aluminum fiber 27 in the case 13 is pressed downward by the rod member 33 and plastically deforms to be pressingly attached to the internal of the case 13. The aluminum fiber 27 is thus fixed and in tight contact with the internal surface of the case 13 to function as an acoustic resistance body.

FIG. 2C illustrates the state after pulling out the rod member 33 from the case 13. The acoustic resistance body 27 formed of aluminum fiber having in the central portion the pocket 28, of which open cross sectional area gradually decreases, is fixed in the internal bottom section of the case 13. The acoustic resistance body 27 is fixed to be in tight contact with the internal surface of the bottom end of the case 13.

The acoustic resistance body 27 formed of aluminum fiber in the aforementioned step has fiber density distribution such that the fiber density is low in the portion close to the opening of the case 13 and high in the portion close to the bottom end of the case 13. Even when the density is substantially uniform throughout the body, similar effect can be provided.

The case 13 containing the acoustic resistance body 27 as illustrated in FIG. 2C is then attached to the dynamic microphone unit 15 so as to communicate with the back side of the diaphragm 17 through the opening 13*a* as illustrated in FIG. 1.

In the dynamic microphone illustrated in FIG. 1, the conical pocket 28, which is provided in the acoustic resistance body 27 formed of aluminum fiber, effectively avoids the generation of standing waves in the back-side air chamber 14. Thus, a dynamic microphone which receives no effect from standing waves in the back-side air chamber 14 can be provided.

Since the acoustic resistance body 27 formed of aluminum fiber is contained in, and in tight contact with, the internal surface of the bottom end of the case 13 constituting the back-side air chamber 14, the aluminum fiber suppresses free vibration of the wall constituting the case 13, and therefore the wall of the back-side air chamber 14 is prevented from having a certain resonance frequency.

In addition, the degradation of directional frequency response of the microphone caused by the resonance frequency of the wall of the back-side air chamber 14 can surely be prevented.

Figure 3:
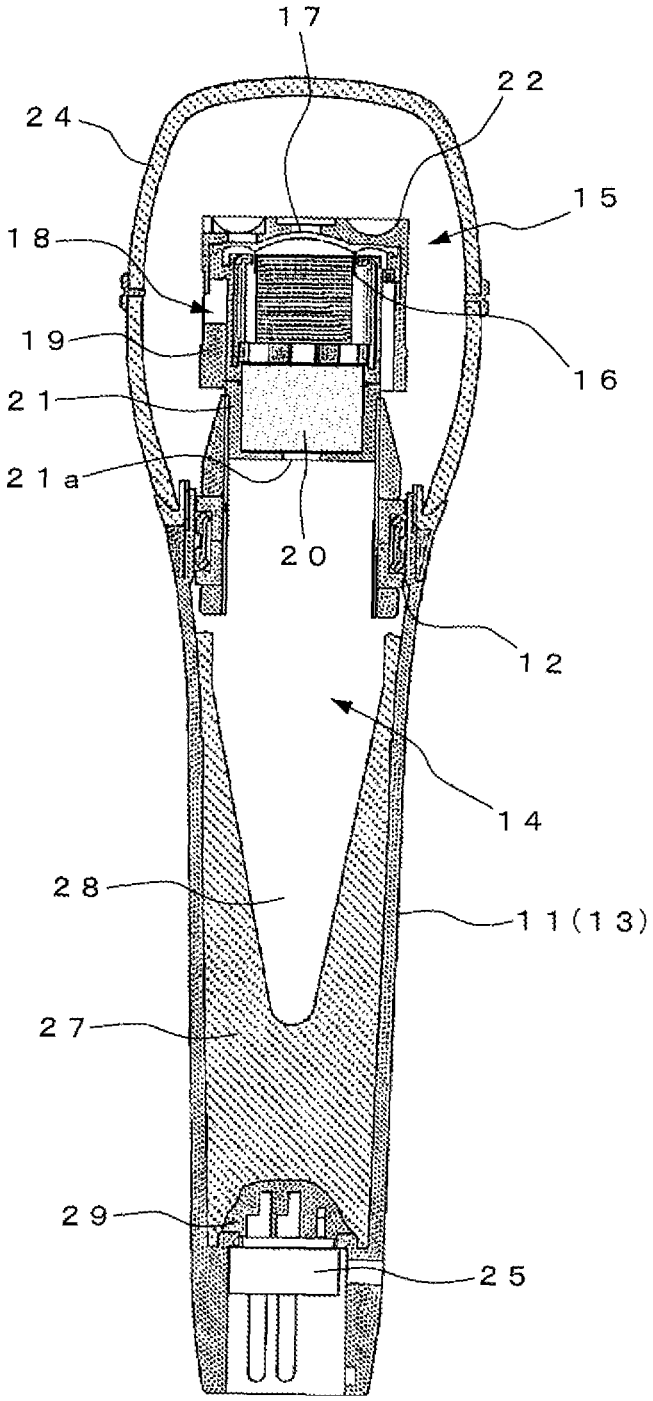
FIG. 3 is a center cross sectional view illustrating the general configuration of a dynamic microphone having another configuration according to the present invention.

FIG. 3 illustrates a second embodiment of the dynamic microphone according to the present invention. The embodiment illustrated in FIG. 3 uses the grip case 11 as a case in place of the case 13 forming the back-side air chamber 14 illustrated in FIG. 1.

The component in FIG. 3 having the same function as the function of the component of the dynamic microphone illustrated in FIG. 1 is appended with the same reference sign and the description thereof is omitted.

In the example illustrated in FIG. 3, the grip case 11 is used as the case 13 forming the back-side air chamber 14. The sealing member 29 covering from inside the output connector 25 attached to the rear end of the grip case 11 is provided on the bottom end of the grip case 11. The sealing member 29 fixes the output connector 25 to the grip case 11 and constitutes the bottom of the case to form the back-side air chamber.

The method of forming the acoustic resistance body 27 with aluminum fiber in the grip case 11 to have a pocket 28 is similar to the example illustrated in FIGS. 2A to 2C.

The example illustrated in FIG. 3 can thus have an effect similar to the effect of the dynamic microphone illustrated in FIG. 1.

In addition, the second example of the dynamic microphone illustrated in FIG. 3 effectively uses the volume of the grip case 11 to form the back-side air chamber 14, and thus improves the low frequency profile of the dynamic microphone.

The embodiment described above is configured to have a single conical pocket 28 in the central portion of the acoustic resistance body 27 formed of metal fiber. Although, for an embodiment configured to have a plurality of pockets each having the open cross sectional area gradually decreasing along the longitudinal direction of the case 13 or the grip case 11, similar effect can be obtained.

For the embodiment having a plurality of pockets 28, each having gradually decreasing open cross sectional area, in the acoustic resistance body 27, a rod member 33 having a plurality of protrusions 33*a* of a conical shape, for example, on the distal end can be used in place of the rod member 33 illustrated in FIG. 2B to form a plurality of pockets 28 by plastically deforming the acoustic resistance body 27 in a similar manner.

In the embodiment described above, aluminum fiber is used as the metal fiber. For example, a metal fiber other than aluminum fiber which plastically deforms by receiving the pressure of the rod member 33 as illustrated in FIGS. 2A to 2C (for example, metal fiber of stainless steel, iron, nickel, or copper) can be used in a similar manner.

What is claimed is:

1. A dynamic microphone comprising:

a dynamic microphone unit including a diaphragm including a voice coil and a magnetic circuit including a magnetic gap, the voice coil being disposed in the magnetic gap so as to vibrate;

a bottomed case coupled to the dynamic microphone unit and forming a back-side air chamber communicating with a back side of the diaphragm; and an acoustic resistance body formed of metal fiber including a pocket and attached to an inside of the case, the pocket being formed to have an open cross sectional area gradually decreasing toward a direction remote from the dynamic microphone unit, wherein the pocket is a concave formed in the acoustic resistance body and having said open cross sectional area gradually decreasing from an upper portion of the acoustic resistance body in the direction remote from the dynamic microphone unit.

2. The dynamic microphone according to claim 1, wherein the metal fiber is aluminum fiber.

3. The dynamic microphone according to claim 1 further comprising a plurality of pockets, each of the pockets being formed to have an open cross sectional area gradually decreasing toward the direction remote from the dynamic microphone unit.

4. The dynamic microphone according to claim 2 further comprising a plurality of pockets, each of the pockets being formed to have an open cross sectional area gradually decreasing toward the direction remote from the dynamic microphone unit.

5. The dynamic microphone according to claim 1, wherein the metal fiber pressingly attached to the inside of the case is in tight contact with an internal surface of the case.

6. The dynamic microphone according to claim 2, wherein the metal fiber pressingly attached to the inside of the case is in tight contact with an internal surface of the case.

7. The dynamic microphone according to claim 3, wherein the metal fiber pressingly attached to the inside of the case is in tight contact with an internal surface of the case.

8. The dynamic microphone according to claim 4, wherein the metal fiber pressingly attached to the inside of the case is in tight contact with an internal surface of the case.

9. The dynamic microphone according to claim 1, wherein the case forming the back-side air chamber is a grip case configured to support the microphone unit.

10. The dynamic microphone according to claim 1, wherein the case forming the back-side air chamber is contained in a grip case configured to support the microphone unit.

11. The dynamic microphone according to claim 10, wherein the case is coaxially attached inside the grip case via a shock-mount member.

12. A dynamic microphone comprising:

a dynamic microphone unit including a diaphragm including a voice coil and a magnetic circuit including a magnetic gap, the voice coil being disposed in the magnetic gap so as to vibrate;

a bottomed case coupled to the dynamic microphone unit and forming a back-side air chamber communicating with a back side of the diaphragm; and an acoustic resistance body formed of metal fiber including a pocket and attached to the inside of the case, the pocket being formed to have an open cross sectional area gradually decreasing toward a direction remote from the dynamic microphone unit, wherein, the acoustic resistance body has fiber density distribution such that fiber density is low in a portion close to an opening of the case and high in a portion close to a bottom of the case.

13. A method of forming a back-side air chamber communicating with back side of a diaphragm of a dynamic microphone unit, the method comprising:

inserting a certain amount of metal fiber in a bottomed case having an opening which communicates with the back side of the diaphragm;

forming a pocket in the metal fiber in the case by plastic deformation by inserting a rod member having a protrusion, an outer diameter of which decreases toward a distal end, from the opening of the case, the pocket being formed in a shape corresponding to a shape of the protrusion of the rod member; and pulling out the rod member from the opening of the case to obtain an acoustic resistance body formed of metal fiber having a pocket in an internal bottom section of the case, the pocket having a gradually decreasing open cross sectional area to form the back-side air chamber.

14. The method of forming a back-side air chamber according to claim 13, wherein the metal fiber comes in tight contact with an internal surface of the case by the forming, by plastic deformation, of a pocket having a shape corresponding to a shape of the protrusion of the rod member in the metal fiber.

15. The method of forming a back-side air chamber according to claim 13, wherein aluminum fiber is used as the metal fiber.

16. The method of forming a back-side air chamber according to claim 14, wherein aluminum fiber is used as the metal fiber.

17. The dynamic microphone according to claim 1, wherein the dynamic microphone unit further comprises a cap member coupled to the bottomed case and including a wall with a sound hole facing the diaphragm for communicating the back side of the diaphragm and the back-side air chamber, and the cap member houses another acoustic resistance body between the magnetic circuit and the wall, and the wall is arranged between the acoustic resistance body and the another acoustic resistance body.

* * * * *